US011043773B2

(12) United States Patent
Ambo

(10) Patent No.: US 11,043,773 B2
(45) Date of Patent: Jun. 22, 2021

(54) ELECTRICAL CONNECTOR

(71) Applicant: DELTA PLUS CO., LTD., Mie (JP)

(72) Inventor: Tsugio Ambo, Saitama (JP)

(73) Assignee: DELTA PLUS CO., LTD., Mie (JP)

( * ) Notice: Subject to any disclaimer, the term of this patent is extended or adjusted under 35 U.S.C. 154(b) by 0 days.

(21) Appl. No.: 16/886,916

(22) Filed: May 29, 2020

(65) Prior Publication Data

US 2020/0388953 A1 Dec. 10, 2020

(30) Foreign Application Priority Data

Jun. 5, 2019 (JP) ..... JP2019-105148

(51) Int. Cl.
*H01R 13/506* (2006.01)
*H01R 13/52* (2006.01)
*H01R 13/627* (2006.01)

(52) U.S. Cl.
CPC ..... *H01R 13/5219* (2013.01); *H01R 13/506* (2013.01); *H01R 13/6272* (2013.01)

(58) Field of Classification Search
CPC ..... H01R 13/5219; H01R 13/506; H01R 13/6272
See application file for complete search history.

(56) References Cited

U.S. PATENT DOCUMENTS

| | | | | |
|---|---|---|---|---|
| 7,553,186 | B2 * | 6/2009 | Morikawa | H01R 13/5208 439/587 |
| 8,777,648 | B2 * | 7/2014 | Kitajima | H01R 13/5202 439/271 |
| 8,979,554 | B2 * | 3/2015 | Yudate | H01R 13/5202 439/76.1 |
| 10,476,201 | B2 * | 11/2019 | Siwek | H01R 13/5219 |
| 2001/0009823 | A1 * | 7/2001 | Suzuki | H01R 13/5205 439/587 |
| 2004/0110419 | A1 * | 6/2004 | Nishida | H01R 13/5219 439/587 |

FOREIGN PATENT DOCUMENTS

| | | | |
|---|---|---|---|
| JP | H10512388 | A | 11/1998 |
| JP | 2016119186 | A | 6/2016 |
| JP | 2016122524 | A | 7/2016 |
| JP | 2017212159 | A | 11/2017 |

* cited by examiner

*Primary Examiner* — Tho D Ta
(74) *Attorney, Agent, or Firm* — Li & Cai Intellectual Property (USA) Office

(57) ABSTRACT

Seal portions at two locations communicate with each other and are integrated with each other to realize a waterproof structure. A first seal portion is provided onto an outer surface at a tip of a central cylinder inside a housing main body to realize a waterproof structure where a gap between the outer surface and a housing of a mating electrical connector is sealed in a waterproof manner. The seal portion is also connected to an inner surface of the central cylinder through a communication hole provided in the central cylinder, and a second seal portion is provided on the inner surface, integrally with the seal portion, to realize a waterproof structure where a gap between the inner surface and a terminal holder is sealed in a waterproof manner.

4 Claims, 4 Drawing Sheets

ELECTRICAL CONNECTOR

FIELD OF THE DISCLOSURE

The present invention relates to an electrical connector which is used, for example, in the connection of electric circuits of an automobile and in which seal members are integrally formed at a plurality of internal locations.

FIELD OF THE DISCLOSURE

An electrical connector used in an automobile or the like requires a waterproof structure using a seal member so as to prevent water from infiltrating into internal electrical components.

In this case, a housing main body of the electrical connector has to fix connection terminals, and use a seal member having an annular shape and made of, for example, a synthetic rubber or the like when the electrical connector is fitted onto a mating electrical connector, to realize a waterproof structure thereinside. Besides, normally, as a waterproof measure for an individual connection terminal itself, one cylindrical seal is provided onto each of the connection terminals.

In addition, when the housing main body itself does not directly fix the connection terminals, and the connection terminals are held in a separate member such as a terminal holder which is present inside the housing main body, a waterproof structure has to be also applied to a gap between the housing main body and the member holding the connection terminals. Therefore, in this case, the housing main body requires seal members having an annular shape at two locations, namely, a seal member for the foregoing mating electrical connector and a seal member for the member holding the connection terminals.

For example, JP-A-2016-33893 discloses this type of electrical connector in which separate waterproof seal members are disposed at two locations on both inner and outer surfaces of a protruding portion that is present in a female housing.

However, the electrical connector disclosed in JP-A-2016-33893 requires two separate waterproof seal members, thus leading to an increase in the number of components or an increase in assembly working time. In many cases, the seal members are manually attached into the housing main body, and when the insertion of one of the seal members is forgotten, a serious accident may occur, which is a problem.

SUMMARY OF THE DISCLOSURE

An object of the invention is to solve the foregoing problems, and to provide an electrical connector in which seal members at two locations inside a housing main body are integrally molded to communicate with each other.

In the electrical connector according to the invention, a waterproof structure in a state where a front side of the housing main body is connected to a mating electrical connector, and a waterproof structure in a state where the front side of the housing main body is connected to a terminal holder which is present inside the housing main body are realized by seal portions at two locations on the both inner and outer surfaces of a central cylinder, which communicate with each other and are integrated with each other inside the housing main body.

In addition, since the seal portions at the two locations on the both inner and outer surfaces of the central cylinder are integrally molded to communicate with each other through a communication hole provided in the central cylinder by injection molding, the number of components is reduced, the production also becomes easy, and either of the seal portions is not unexpectedly detached.

DETAILED DESCRIPTION OF THE EXEMPLARY EMBODIMENTS

The invention will be described in detail based on an illustrated example.

Figure 1:
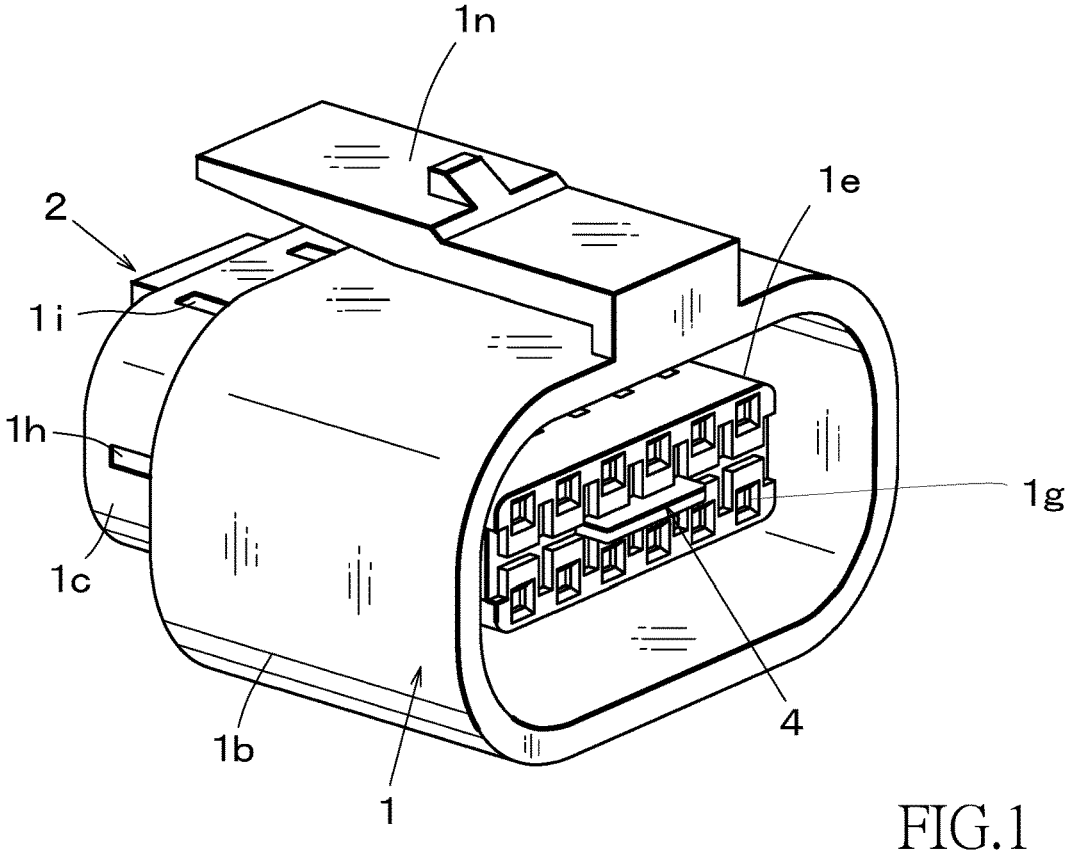
FIG. 1 is a perspective view of an electrical connector in an assembled state as seen from front.
Figure 2:
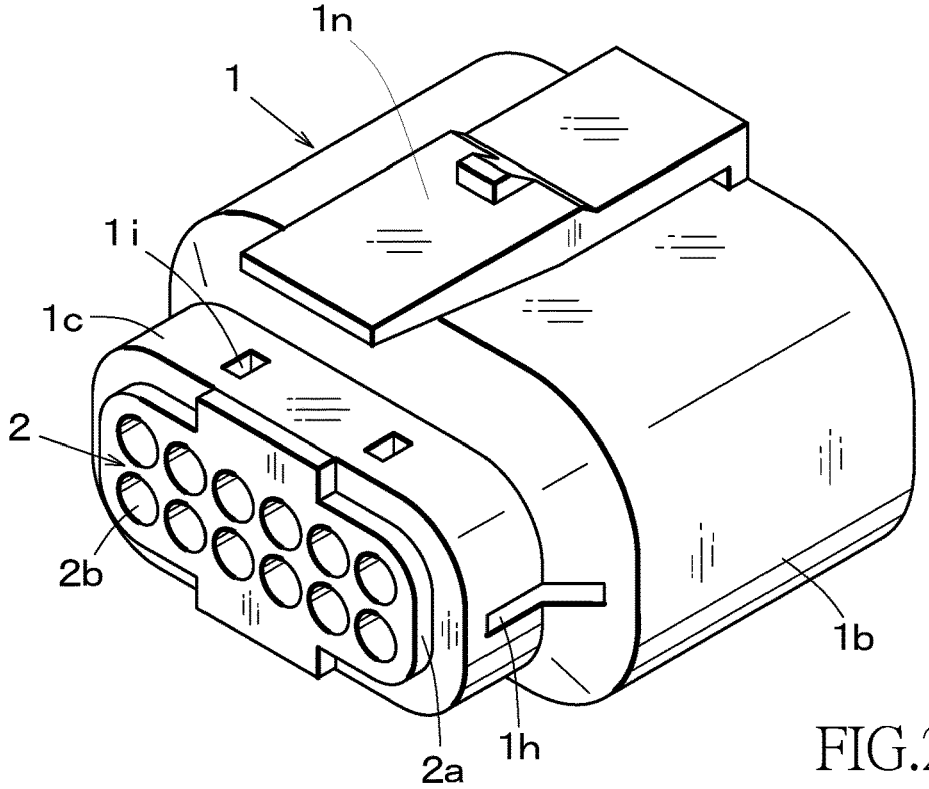
FIG. 2 is a perspective view seen from rear.
Figure 3:
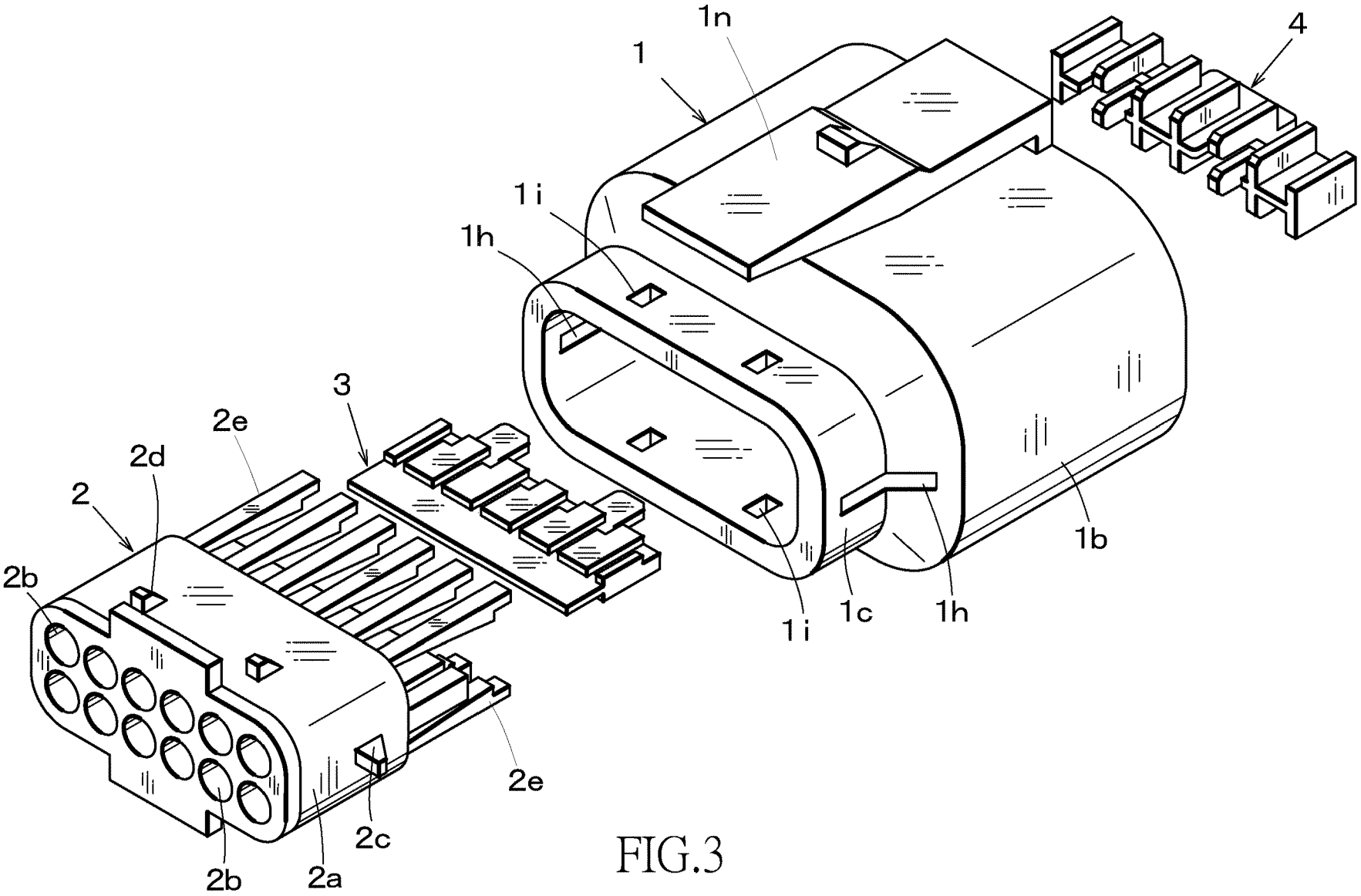
FIG. 3 is a perspective view of the electrical connector in a disassembled state as seen from rear.
Figure 4:
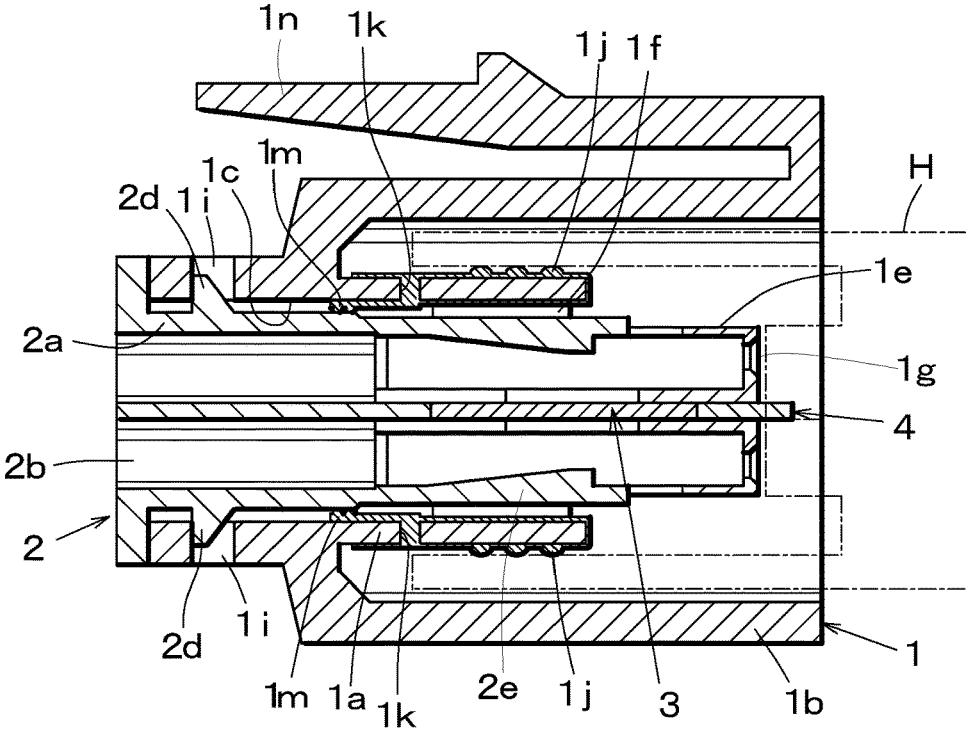
FIG. 4 is a longitudinal section view of the electrical connector in an assembled state taken in a vertical direction.
Figure 5:
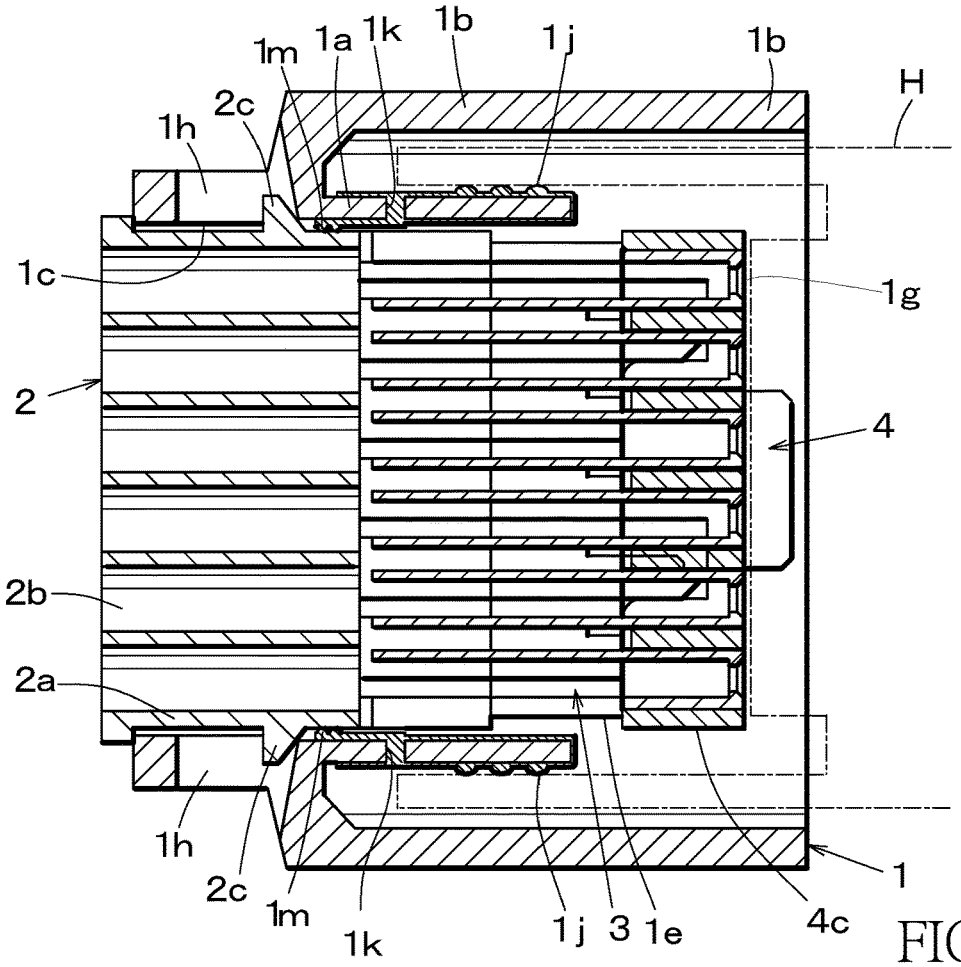
FIG. 5 is a longitudinal section view taken in a horizontal direction.

FIG. 1 is a perspective view of an electrical connector in an assembled state in the example as seen from front. FIG. 2 is a perspective view seen from rear. FIG. 3 is a perspective view of the electrical connector in a disassembled state as seen from rear. FIG. 4 is a longitudinal section view of the electrical connector in an assembled state taken in a vertical direction, and FIG. 5 is a longitudinal section view taken in a horizontal direction.

The electrical connector includes a housing main body 1, a terminal holder 2 that is inserted into the housing main body 1 from a rear of the housing main body 1, a locking plate 3 that is connected to a front end of the terminal holder 2 and is movable in a transverse direction orthogonal to an insertion direction of the terminal holder 2, and an operating member 4 that moves the locking plate 3 inside the housing main body 1 in the transverse direction. Incidentally, each of the housing main body 1, the terminal holder 2, the locking plate 3, and the operating member 4 is made of a synthetic resin material by injection molding.

The terminal holder 2 is inserted from a rear portion of the housing main body 1 to be fitted thereinto, and the terminal holder 2 holds a rear end portion of a connection terminal to be described later. In addition, the locking plate 3 is connected to a tip of the terminal holder 2 so as to be movable in the transverse direction. The locking plate 3 is inserted into the housing main body 1, together with the terminal holder 2, and is operated by the operating member 4 that is pushed in from a front portion of the housing main body 1. The operating member 4 is pushed in to cause the locking plate 3 to move with respect to the terminal holder 2 in the transverse direction orthogonal to the insertion direction of the terminal holder 2 and to lock a rear end of the connection terminal which is built in the terminal holder 2, so that the connection terminal is not allowed to move forward and rearward with respect to the terminal holder 2.

Figure 6:
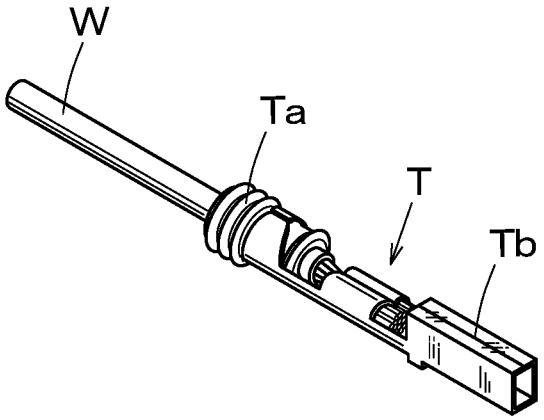
FIG. 6 is a perspective view of a connection terminal.

As illustrated in FIG. 6, for example, an electrical wire W is provided onto a connection terminal T, which is a so-called female terminal, through a cylindrical waterproof seal Ta made of a synthetic rubber, and for example, a total of twelve connection terminals T of which six rows of the connection terminals T are arranged in each of two upper and lower stages can be inserted into the electrical connector from a rear side of the terminal holder 2. Incidentally, a tip of the connection terminal T serves as a connection portion Tb having a rectangular tube shape which is fitted onto a mating male terminal. Then, the housing main body 1 is fitted onto a housing H of a mating electrical connector including the same number of built-in insertion type connection terminals, so that electrical connection is performed through the male and female connection terminals.

In regard to the size of the electrical connector in an assembled state, for example, the width is 24 mm, the height is 14 mm, and the length is 24 mm, and the electrical connector of the appropriate size can be adopted depending on the size and the number of the connection terminal T which is built in.

A central cylinder 1*a* and an outer cylinder 1*b* are integrally molded such that the central cylinder 1*a* is provided in a central portion of the housing main body 1, the outer cylinder 1*b* of the housing main body 1 is disposed outside the central cylinder 1*a* so as to largely surround the central cylinder 1*a* with a gap provided therebetween, and a rear portion of the outer cylinder 1*b* is connected a rear of the central cylinder 1*a*.

A rear portion of the central cylinder 1*a* opens rearward to allow the terminal holder 2 to be inserted thereinto, a frame 2*a* at a rear of the terminal holder 2 which is inserted is held by a holder holding portion 1*c*, and a front end of the central cylinder 1*a* serves as a waterproof portion. Then, the housing H of the mating electrical connector is inserted between the central cylinder 1*a* and the outer cylinder 1*b* in use.

A terminal holding portion le having a cylindrical shape and having a smaller diameter than that of the central cylinder 1*a* is formed inside the central cylinder 1*a* and forward therefrom, with a slight gap from the central cylinder 1*a*, and the terminal holding portion le is supported by a plurality of ribs if from an inside of the central cylinder 1*a*. The terminal holding portion le holds the connection portion Tb of the connection terminal T thereinside, and a front end portion of the terminal holding portion le is closed except for an opening 1*g* into which the male connection terminal of the mating connector is inserted. In addition, grooves 1*h* for preliminary insertion of which each has a long groove shape are formed in both side portions of the holder holding portion 1*c*, and two grooves 1*i* for main insertion are formed in each of upper and lower portions of the holder holding portion 1*c*.

A rear end of the frame 2*a* at the rear of the terminal holder 2 is provided with open holes 2*b* into which the connection terminals T are individually inserted. Locking protrusions 2*c* for preliminary insertion are provided on right and left sides of the frame 2*a* of the terminal holder 2, and when the terminal holder 2 is inserted into the housing main body 1 in such a manner that the terminal holder 2 is preliminarily inserted with respect to the housing main body 1, the locking protrusions 2*c* for preliminary insertion are engaged into the grooves 1*h* for preliminary insertion of the holder holding portion 1*c*. In addition, two locking protrusions 2*d* for main insertion are provided on each of upper and lower sides of the frame 2*a*, and when the terminal holder 2 is inserted, the locking protrusions 2*d* for main insertion are engaged into the grooves 1*i* for main insertion of the holder holding portion 1*c*. Incidentally, the tip of the terminal holder 2 is provided with a locking arm 2*e* having an elastic force for individually locking rear ends of the connection portions Tb of the connection terminals T.

The periphery of a tip of the central cylinder 1*a* is surrounded by a synthetic rubber formed of, for example, silicon rubber and serving as a waterproof member. Then, a seal portion 1*j*, which is a first seal portion that is in contact with the housing H of the mating electrical connector to realize a waterproof structure where a gap between the tip of the central cylinder 1*a* and the housing H is sealed in a waterproof manner, is formed on an outer surface of the tip of the central cylinder 1*a* except for the ribs if to go around the outer surface. The seal portion 1*j* is also in contact with an inner surface of the central cylinder 1*a* through communication holes 1*k* that are a plurality of small holes and are provided in a base portion of the central cylinder 1*a*. A seal portion 1*m*, which is a second seal portion that is in contact with the terminal holder 2 to realize a waterproof structure where a gap between the inner surface of the central cylinder 1*a* and the terminal holder 2 is sealed in a waterproof manner, is formed on the inner surface of the central cylinder 1*a* to go around an inner surface of the base portion of the central cylinder 1*a*. The seal portions 1*j* and 1*m* communicate with each other through the communication holes 1*k* and are integrated with each other.

The seal portion 1*j* and the seal portion 1*m* connected to the seal portion 1*j* are integrally molded on both inner and outer surfaces of the central cylinder 1*a*, which is made of a hard synthetic resin material, through a plurality of the communication holes 1*k* by, for example, injection molding. Since the central cylinder 1*a* and the seal portions 1*j* and 1*m* are strongly joined together, and the seal portions 1*j* and 1*m* are connected to each other through the communication holes 1*k* provided in the central cylinder 1*a*, and are integrated with each other, it does not happen that only one of the seal portions 1*j* and 1*m* is attached or only one is unexpectedly detached.

Furthermore, the surfaces of the seal portions 1*j* and 1*m* on the both inner and outer surfaces of the central cylinder 1*a* have a waveform cross-section for effectively preventing the infiltration of water. It is preferable that when the housing main body 1 is injection-molded, the seal portions 1*j* and 1*m* are provided thereonto by injection-molding silicon rubber using two-color molding and are further crosslinked. Since the first seal portion 1*j* seals a gap between the tip of the central cylinder 1*a* and the housing H of the mating electrical connector in a waterproof manner, and the mating electrical connector is repeatedly mounted and removed and is likely to move greatly, in order to reinforce the first seal portion 1*j*, the first seal portion 1*j* has a larger cross-sectional area and a larger waveform shape than those of the second seal portion 1*m*.

Incidentally, an upper portion of the housing main body 1 is provided with a locking arm 1*n* for maintaining a state where the housing H of the mating connector is fitted into the housing main body 1.

When the electrical connector is assembled, firstly, the terminal holder 2 with the locking plate 3 attached to the tip thereof is installed in a preliminary insertion state of the terminal holder 2 with respect to the housing main body 1. The preliminary insertion state is realized when the locking protrusions 2*c* for preliminary insertion provided in the terminal holder 2 are engaged into the grooves 1*h* for preliminary insertion of the holder holding portion 1*c*. When the connection terminals T are inserted into the open holes 2*b* of the terminal holder 2 in the preliminary insertion state of the terminal holder 2, the connection portions Tb deflect and push up the locking arm 2*e*, and when the connection portions Tb pass through the locking arm 2*e*, the locking arm 2*e* is restored and the connection portions Tb are locked by hooks of the locking arm 2*e*, so that the connection portions Tb are prevented from falling out rearward.

Subsequently, the terminal holder 2 is further pushed into the housing main body 1, and the locking protrusions 2*d* for main insertion of the terminal holder 2 are fitted into the grooves 1*i* for main insertion of the holder holding portion 1*c*, so that a main insertion state of the terminal holder 2 with respect to the housing main body 1 is realized. Thereafter, the operating member 4 is pushed in toward the terminal holder 2 from a front of the housing main body 1, and the locking plate 3 is moved in the transverse direction by the operating member 4 to individually fix the connection terminals T, so that the electrical connector is assembled.

In the main insertion state of the terminal holder 2, a waterproof structure where the gap between the terminal holder 2 and the housing main body 1, namely, the inner surface of the central cylinder 1*a* is sealed in a waterproof manner is realized by the second seal portion 1*m* provided on the inner surface of the central cylinder 1*a*. In addition, when the fitting in of the mating electrical connector is performed, the housing H of the mating electrical connector is inserted between the central cylinder 1*a* and the outer cylinder 1*b*, and a waterproof structure where the gap between the housing main body 1, namely, the outer surface of the central cylinder 1*a* and the housing H is sealed in a waterproof manner is realized by the first seal portion 1*j* provided on the outer surface of the central cylinder 1*a*.

In this manner, in the electrical connector, a waterproof structure in a state where a front side of the housing main body 1 is connected to the housing H of the mating electrical connector, and a waterproof structure in a state where the front side of the housing main body 1 is connected to the terminal holder 2 which is a separate body and is present inside the housing main body 1 are realized by the seal portions 1*j* and 1*m* at two locations on the both inner and outer surfaces of the central cylinder 1*a*, which communicate with each other inside the housing main body 1.

In addition, since the seal portions 1*j* and 1*m* at two locations on the both inner and outer surfaces of the central cylinder 1*a* are integrally molded to communicate with each other through the central cylinder 1*a* by injection molding, the number of components is reduced, and the production also becomes easy. Therefore, it is not necessary to manually attach individual seal members as in the related art, and there is no occurrence of forgetting to attach the seal members.

What is claimed is:

1. An electrical connector comprising:

a housing main body including a central cylinder provided in a central portion of the housing main body, and an outer cylinder disposed outside the central cylinder to surround the central cylinder with a gap provided therebetween; and a terminal holder that holds a plurality of connection terminals and is inserted into an inside of the central cylinder inside the housing main body from a rear of the housing main body, wherein a mating electrical connector including built-in mating connection terminals facing the connection terminals is fitted into a front of the housing main body, so that electrical connection is performed through the connection terminals and the mating connection terminals, and a housing of the mating electrical connector is inserted between the central cylinder and the outer cylinder, the central cylinder is provided with a communication hole passing through both inner and outer surfaces of the central cylinder, and first and second seal portions made of a synthetic rubber which communicate with each other through the communication hole and are integrated with each other are formed on the both inner and outer surfaces of the central cylinder, and the first seal portion on the outer surface of the central cylinder is in contact with the housing of the mating electrical connector to realize a waterproof structure between the outer surface and the housing, and the second seal portion on the inner surface of the central cylinder is in contact with the terminal holder to realize a waterproof structure between the inner surface and the terminal holder.

2. The electrical connector according to claim 1, wherein each of the first and second seal portions has a waveform cross-section.

3. The electrical connector according to claim 1, wherein the first seal portion has a larger cross-sectional area than that of the second seal portion.

4. The electrical connector according to claim 1, wherein the first and second seal portions are formed by injection molding.

* * * * *